US009447665B2

(12) United States Patent
Morrow

(10) Patent No.: US 9,447,665 B2
(45) Date of Patent: Sep. 20, 2016

(54) APPARATUS FOR CONNECTING AND DISCONNECTING A DOWNHOLE ASSEMBLY

(71) Applicant: HARRIER TECHNOLOGIES, INC., Greenwich, CT (US)

(72) Inventor: William Bruce Morrow, Santa Barbara, CA (US)

(73) Assignee: HARRIER TECHNOLOGIES, INC., Greenwich, CT (US)

( * ) Notice: Subject to any disclaimer, the term of this patent is extended or adjusted under 35 U.S.C. 154(b) by 277 days.

(21) Appl. No.: 14/153,397

(22) Filed: Jan. 13, 2014

(65) Prior Publication Data

US 2014/0196886 A1 Jul. 17, 2014

Related U.S. Application Data

(60) Provisional application No. 61/752,157, filed on Jan. 14, 2013.

(51) Int. Cl.
*E21B 43/12* (2006.01)
*E21B 17/02* (2006.01)

(52) U.S. Cl.
CPC ..... *E21B 43/126* (2013.01); *E21B 17/02* (2013.01)

(58) Field of Classification Search
CPC ..... E21B 43/126; E21B 17/02; E21B 17/04; E21B 31/18
See application file for complete search history.

(56) References Cited

U.S. PATENT DOCUMENTS 4,428,441 A * 1/1984 Dellinger ..... E21B 7/04 175/325.1
4,548,437 A * 10/1985 Driskill ..... E21B 31/18 294/86.18
5,015,162 A * 5/1991 Heppner ..... E21B 43/126 403/349
5,209,294 A * 5/1993 Weber ..... E21B 43/121 166/105
5,501,580 A * 3/1996 Barrus ..... E21B 43/128 166/107
5,584,342 A * 12/1996 Swinford ..... E21B 23/00 166/237
5,954,483 A * 9/1999 Tetzlaff ..... E21B 31/00 166/105
6,092,612 A * 7/2000 Brady ..... E21B 10/60 175/325.2
6,161,635 A * 12/2000 Brady ..... E21B 10/60 175/324
6,561,775 B1 * 5/2003 Wefers ..... F04C 13/008 417/423.3
7,543,633 B2 * 6/2009 Brown ..... E21B 43/126 166/105.5
7,549,849 B2 * 6/2009 Watson ..... F04D 13/021 310/58

(Continued)

*Primary Examiner* — Jennifer H Gay
(74) *Attorney, Agent, or Firm* — Ladas & Parry LLP

(57) ABSTRACT

In a well extending from the surface of the earth to a deposit of production fluid there beneath, a system for delivering the contents of the deposit to the earth's surface. The system comprising a rod string capable of being driven by a source of motive power at the earth's surface, including an internally overshot assembly rod at the end of the rod string; a downhole assembly, including a pump and receiver with a shaft extending upwardly from the downhole assembly, the receiver shaft being connectable to the overshot assembly such that rotation of the rod string and overshot assembly drives the pump to push the production fluid to the surface of the earth.

2 Claims, 3 Drawing Sheets

(56) References Cited

U.S. PATENT DOCUMENTS 7,900,720 B2 * 3/2011 Hall ..... E21B 10/62 175/325.2
7,946,348 B2 * 5/2011 Swinford ..... E21B 17/073 166/117.7
8,021,132 B2 * 9/2011 Green ..... E21B 43/128 417/360
8,302,708 B1 * 11/2012 Cox ..... E21B 17/03 175/300
8,419,390 B2 * 4/2013 Merrill ..... E21B 43/128 417/423.11
9,080,436 B2 * 7/2015 Tetzlaff ..... E21B 43/128
2007/0151739 A1 * 7/2007 Gereluk ..... E21B 17/04 166/379
2007/0235196 A1 * 10/2007 Brown ..... E21B 43/126 166/369
2008/0093126 A1 * 4/2008 Franzen ..... E21B 19/24 175/85
2009/0056497 A1 * 3/2009 Swinford ..... E21B 17/073 74/640
2009/0142207 A1 * 6/2009 Ring ..... F04B 47/06 417/410.1
2009/0152009 A1 * 6/2009 Slay ..... C08K 5/549 175/107
2009/0152011 A1 * 6/2009 Hall ..... E21B 17/046 175/325.2
2009/0202371 A1 * 8/2009 Green ..... E21B 43/128 417/423.3
2009/0291001 A1 * 11/2009 Neuroth ..... E21B 4/006 417/410.1
2010/0150751 A1 * 6/2010 Merrill ..... E21B 43/128 417/410.1
2011/0180273 A1 * 7/2011 Hughes ..... E21B 17/04 166/380
2012/0152563 A1 * 6/2012 Tetzlaff ..... E21B 43/128 166/369
2012/0298376 A1 * 11/2012 Twardowski ..... E21B 17/02 166/378
2013/0330211 A1 * 12/2013 Morrow ..... E21B 43/126 417/62
2014/0196882 A1 * 7/2014 Morrow ..... E21B 43/126 166/68
2014/0196886 A1 * 7/2014 Morrow ..... E21B 43/126 166/105

* cited by examiner

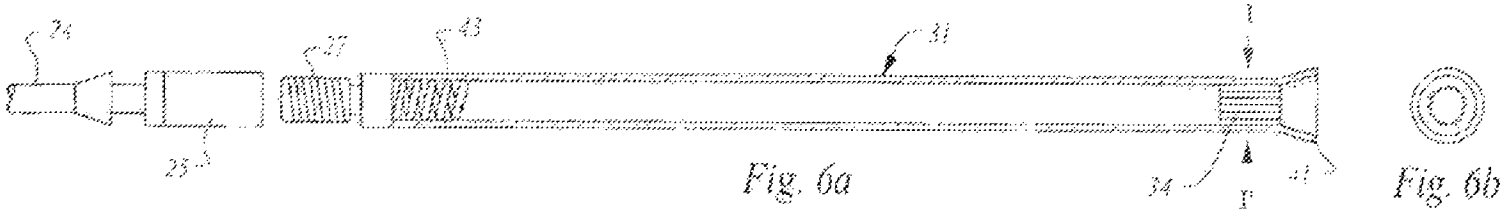
Fig. 6a
Fig. 6b
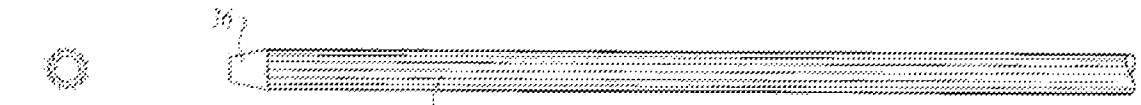
Fig. 7a
Fig. 7b
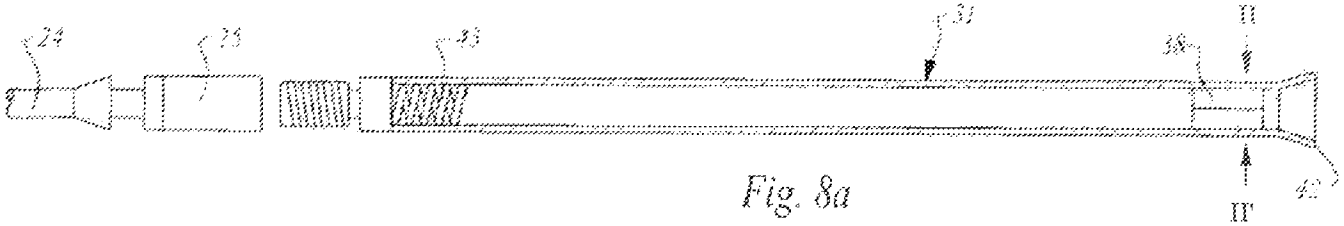
Fig. 8a
Fig. 8b
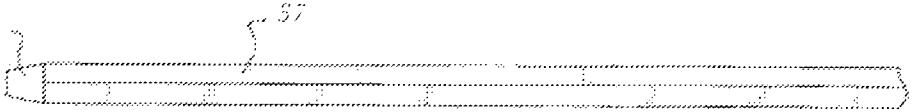
Fig. 9a
Fig. 9b

APPARATUS FOR CONNECTING AND DISCONNECTING A DOWNHOLE ASSEMBLY

This application claims the benefits of earlier filed provisional application Ser. No. 61/752,157, filed on Jan. 14, 2013.

The present invention relates, in a general sense, to oil and gas production wells and, more particularly, to improved apparatus for connecting and disconnecting a downhole assembly including, e.g., geared centrifugal pumps.

BACKGROUND OF THE INVENTION

Field of the Invention

In a typical production well having a well casing extending to a fluid deposit, a downhole assembly is lowered to a predetermined depth from the earth's surface, where it is immersed in a target fluid deposit. The pump, as part of the downhole assembly is driven by a source of motive power, such as a power supply at the surface of the well. A rod string depends from the power source and spans the distance between the power supply and the pump where it is connected to the pump to drive it.

The geared centrifugal pump (GCP), among other devices, utilizes the rod string to rotationally drive a downhole pump. In the case of the GCP, this rod string is run inside the production tubing after the pump assembly has been lowered on said production tubing and set at the desired downhole location. The current method of connecting the rod string to the downhole assembly, so that rotational force can be transmitted to that assembly, is via a male stab-in rod attached to the end of the drive rod string that fits into a companion female receptacle facing upwardly, which is part of a receiver component at the top of the downhole pump assembly.

This stab-in rod, as will later appear in keeping with the invention, may have any one of several cross section configurations, among them a square, a hex, or other cross section that fits snugly into a like-shaped female receptacle in the receiver. The stab-in rod is not attached to the receptacle for tensional loads and is of such length as to permit free movement vertically to adjust to differential vertical movement between the rod string and the overshot assembly. The stab-in rod, via the drive rods, when engaged, rotates the female receptacle, which is fixedly attached to the drive shaft that extends from the receiver through the upper seal section. In the case of the GCP, the drive shaft is attached to the input shaft of a speed increasing transmission, which, in turn, drives a centrifugal pump.

An important disadvantage to prior art systems of a male stab-in shaft and a female receptacle is debris can, and usually will, collect in the female receptacle before the rod string is run, or when the rod string is removed for service, making it somewhere between difficult to impossible to re-engage the stab-in rod into the receiver.

The present invention addresses that problem by eliminating a female receiver that is open to the unwanted collection of receptacle clogging debris.

SUMMARY OF THE INVENTION

In the business of oil and gas production, time is literally money. It is readily understood, therefore, that any difficulty in connecting the rod string to the overshot assembly costs dearly, in both time and money.

With that understanding, it is clearly a great advantage of the present invention to the oil producer, to eliminate prior art difficulties experienced when, as and if the female receptacle is in any way impaired, so as to greatly increase the difficulty with which the rod string is engaged with the downhole assembly.

It is a further benefit of the present invention to provide a mechanism, and a method of operation, which enhances the ability of the producer to connect the rod string with the receiver component of the downhole pump assembly.

Other objects and advantages of the present invention will become apparent to those skilled in the art from a reading of the following Detailed Description Of The Preferred Embodiment when read in concert with the drawings.

It will quickly become apparent that all of the drawings are pictorial representations of the area in the production tubing, wherein the receiver component of the downhole pump assembly is engaged by the drive rod string, and disengaged as needed.

BRIEF DESCRIPTION OF THE DRAWINGS

FIGS. 6*a* and *b* illustrate, pictorially, in side view and cross-section, the overshot device, detached from the drive string, equipped with a female receiver on the inner surface, which mates with, and rotational engages, the upward extending male receiver shaft;

FIGS. 7*a* and *b* illustrate, pictorially, the upward extending receiver shaft, in side view and cross-section, respectively;

FIGS. 8*a* and *b* illustrate, pictorially, in side view and cross-section, the overshot device, detached from the drive string, equipped with a square cross-section inner bore, which mates with, and rotationally engages, the upward extending square cross-section receiver shaft;

FIGS. 9*a* and *b* illustrate, pictorially, the upward extending rectangular cross-section of the receiver shaft, in side view and cross-section, respectively.

DETAILED DESCRIPTION OF A PREFERRED EMBODIMENT

The following detailed description discloses, to those skilled in the art, a novel system 20 for engaging a downhole assembly 22 with a rod drive string 24. Arrows A [FIG. 1] indicate the direction of flow of fluid in the production tubing T and overshot assembly 31.

Figure 1:
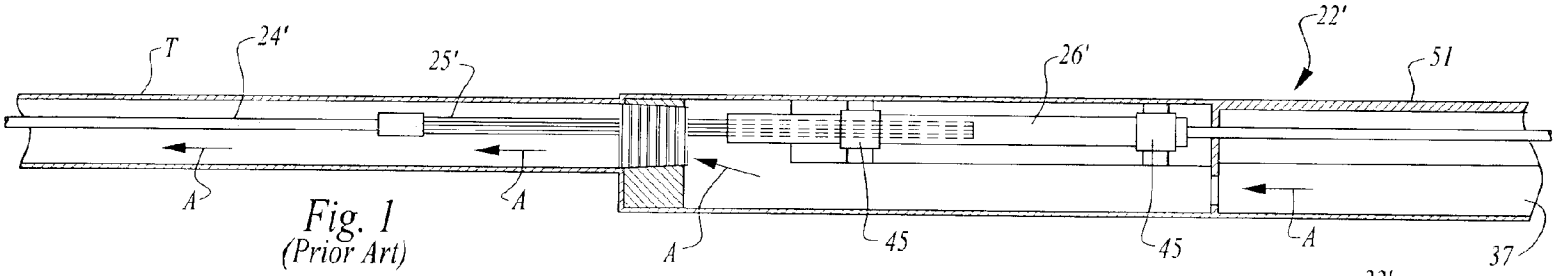
Fig. 1 (Prior Art)
FIG. 1 is a depiction of a prior art upper portion of a downhole assembly with a short section of connecting tubing, in the area of connection between a downhole assembly and a rod drive string, illustrating the mechanics of the connection in current use embodiment, wherein a female receptacle extends upwardly from the receiver component of the downhole assembly and is engaged by a depending drive rod and stab-in shaft.
Figure 2:
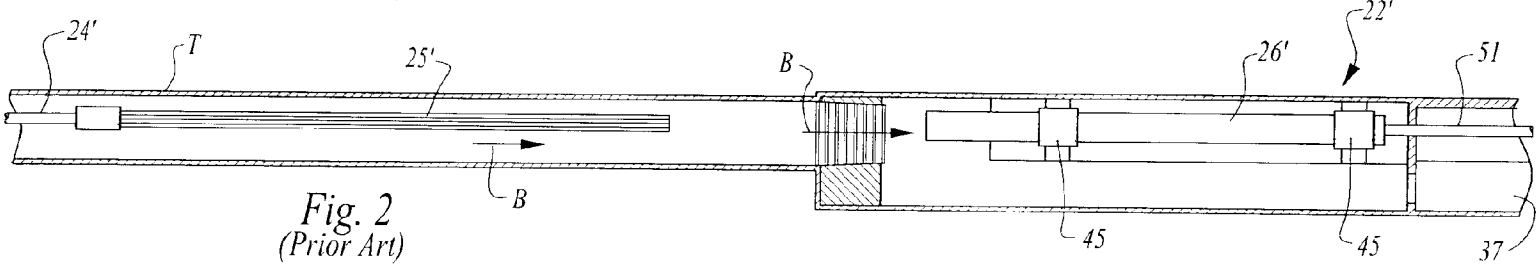
Fig. 2 (Prior Art)
FIG. 2 illustrates, pictorially, the prior art embodiment with the drive rod and stab-in shaft disengaged, leaving the female receptacle open for ingress of debris.

It will be observed that in FIG. 1, which illustrates the current practice in the industry, various elements of the connection system are shown by numbers followed by a prime sign. Drive rod string 24' is attached to stab-in rod 25', at its low end, which is inserted into a female receptacle in receiver 26'. The downhole assembly is thereby rotationally connected to the drive string 24'. This connection arrangement functions satisfactorily until the stab-in rod is removed from the female receiver, as shown in FIG. 2, when the upward facing female receptacle in receiver 26' is open to the ingress of downward moving debris, shown by arrows B.

Figure 3:
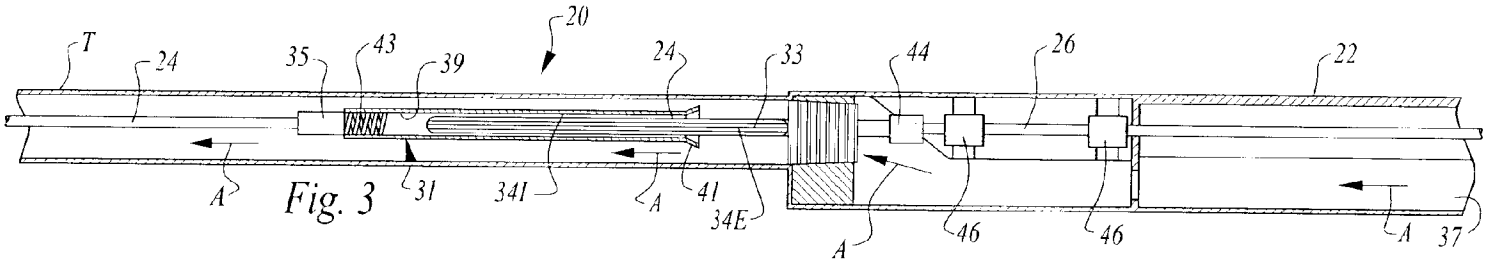
FIG. 3 is a view similar to that of FIG. 1, the difference being the FIG. 3 embodiment illustrates the structure which characterizes the present invention, wherein the connection between the downhole assembly and the drive rod string is via a female overshot assembly engaging an upward extending male receiver shaft.

As shown in FIG. 3, and in accordance with the present invention, the debris-clogging problem inevitably resulting from an open female receptacle in receiver 26' is virtually eliminated by reversing the downhole rod/receiver elements of the connection and making the overshot assembly 31 the female receiver, and the receiver 26 the male connection member.

Figure 4:
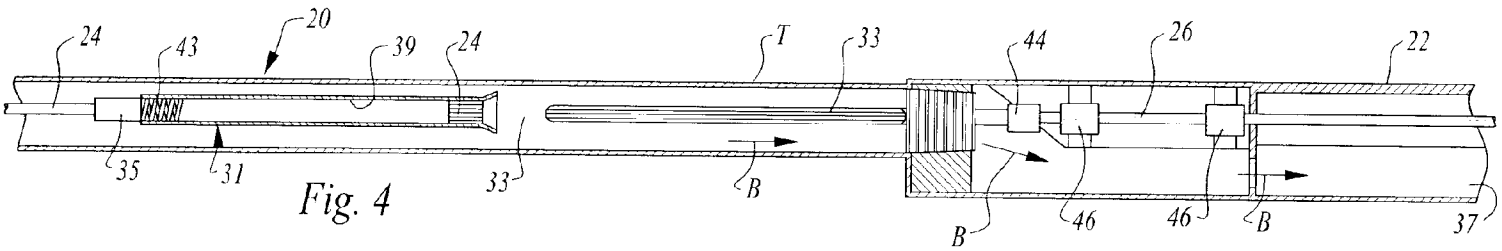
FIG. 4 illustrates, pictorially, the present invention with the drive rod string and overshot assembly disengaged from the receiver shaft.

Accordingly, with this FIG. 3 configuration, and as shown in FIG. 4, when the drive rod string 24 is withdrawn from engagement with the receiver 26, there is no open receptacle facing upwardly towards the surface into which the debris can collect, and the debris, shown as arrows B, falls harmlessly past the receiver 26 where it will settle into the flow channels of the receiver and upper seal section and does not interfere with the connection between the drive rod string 24 and the receiver 26.

There are three main requirements for operationally attaching a rod string to a downhole assembly, and they are:

1. The rod string is lowered after the downhole assembly is installed;
2. The rod string is able to move vertically, freely within a limited travel distance while remaining rotationally connected to the downhole assembly; and,
3. The rod string can be withdrawn and then detached and retrieved without requiring the retrieval of the downhole assembly.

Referring to FIGS. 3 and 4, a novel connection system 20 is configured to show the structure of the present invention in its simplest form.

The system 20 consists of a drive rod-attached overshot assembly 31 and a male receiver shaft 33 attached to the downhole assembly 22. By definition, the overshot assembly 31 is essentially a long, or otherwise configured, female receiver, or coupling, attached at the up-hole end 35 to the drive rod string 24, and having an elongated longitudinal bore 39 terminating in a downwardly facing opening at its free end, with a short length of internal splines 34 opening to the down-hole end 37 to fit over the male receiver shaft 33.

The free downhole end opening is flared as at 41 to provide an entry guide during engagement with the male receiver shaft 33. In practice, the length of the travel distance portion of the overshot assembly 31 would be approximately three feet. This is enough length to accommodate any expected differential vertical movement between the drive rod string 24 and the downhole assembly 22 without becoming disengaged. The overshot assembly 31 would have the female internal portion 34 of the inner bore over only the last approximately two inches of the three feet of potential engagement length, the rest being a smooth bore. At the top of the smooth bore would be a cushioning spring 43 to avoid damage to the male receiver shaft 33, overshot assembly 31 or receiver 26, when the rods are run as far as possible during installation of the drive rod string 24, and the overshot assembly 31 "bottoms out" as the connector shaft hits the spring 43.

The male receiver shaft 33 extends about four feet above the uphole end of the receiver 26 for engagement with the overshot assembly 31. The entire length of the shaft above the receiver 26 is configured so that there would be torsional engagement with the overshot assembly 31 over the entire length of the shaft.

Referring again to FIGS. 3 and 4, the male receiver shaft 33 extends downward into the receiver 26, which is equipped with two or more shaft bearings 46 to locate the shaft securely in the receiver. There is a seal 44 on the male receiver shaft 33 at the top of the receiver to keep debris from entering the receiver 26. The male receiver shaft 33 is connected below the bearings to the main drive shaft that, in the case of the GCP, extends through the upper seal section and connects to the input shaft of the transmission.

Figure 5A:
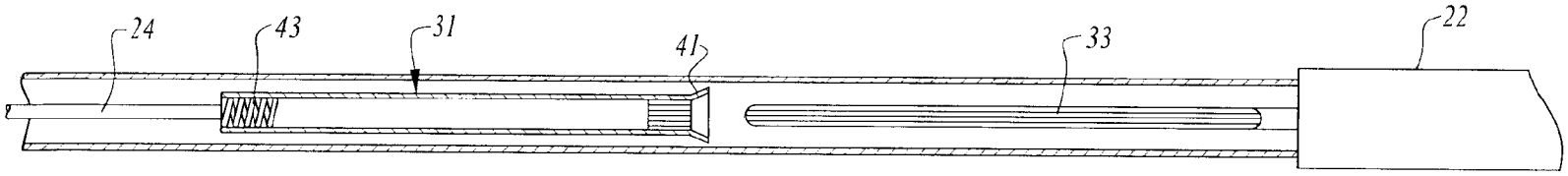
FIGS. 5*a, b* and *c* illustrate, pictorially, a sequence of downhole activity, when one employs the FIG. 3 embodiment, in which an overshot device attached to the drive string is initially moved into position to engage and capture the stab-in rod extending upwardly from the overshot assembly.
Figure 5B:
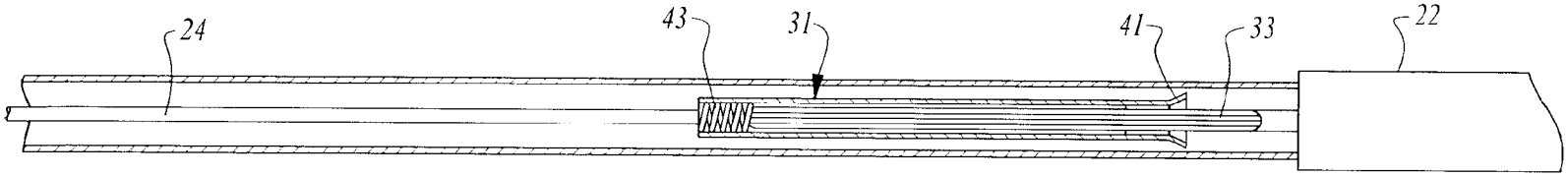
Figure 5C:
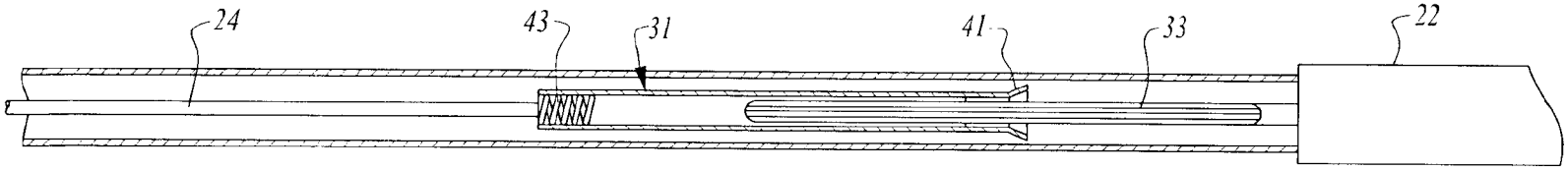

FIGS. 5*a, b*, and *c* show pictorially the process of engaging the receiver 26 with the overshot assembly 31 described above. The bottom-hole equipment is run in the hole on the production tubing T and set at the desired depth. The rods, with the overshot assembly 31 attached to the downhole end, are run near the expected depth of the connection with the male receiver shaft 33 (FIG. 5*a*), and slowly eased down until the overshot assembly 31 fully engages the receiver shaft 33, and the cushioning spring 43 is compressed, so that part of the weight of the rods is carried by receiver shaft 33 (FIG. 5*b*). The rods are then pulled up just to the point where all of the weight of the rod string is carried by the installation equipment at the surface, and then another approximately 1.5 feet, and hung off (FIG. 5*c*). This will give the rods about 1.5 feet of relative downward travel and 1.5 feet of relative upward travel without either tagging the top of the overshot assembly 31, or becoming disengaged from the male receiver shaft 33, respectively.

FIG. 6*a* shows, pictorially, a side view, partial cross-section, of the overshot assembly 31, configured for connection with a male receiver shaft 33. Drive rod string 24 is shown with the coupling 25 detached from the overshot assembly 31 for clarity. Normally, the coupling 25 would fully engage the threaded pin 27 of the overshot assembly 31 for tensional and torsional connection to the drive rod string 24. Cushioning spring 43, the short female inner bore section 34, and flared downhole end opening 41 are clearly shown. FIG. 6*b* shows a cross-section of the overshot assembly 31 through I-I'.

FIG. 7*a* shows a side view of the male receiver shaft 33, showing tapered lead-in 36 at the uphole end of the shaft. FIG. 7*b* shows a cross-section through the male connector or receiver shaft 33.

FIG. 8*a* shows, pictorially, a side view, partial cross-section, of the overshot assembly 31, configured for connection with a female square cross-section receiver shaft 38. Drive rod string 24 is shown with the coupling 25 detached from the overshot assembly 31 for clarity. Cushioning spring 43, the short female square cross-section inner bore 38, and flared downhole end opening 41 are clearly shown. FIG. 8*b* shows a cross-section of the overshot assembly 31 through II-II'.

FIG. 9*a* shows a side view of the rectangular cross-sectioned portion of the male receiver shaft 33, showing the tapered lead-in 36 shape of the uphole end 35 of the shaft. FIG. 9*b* shows a cross-section through the square cross-sectioned portion of the male receiver shaft 33.

In openings, with the downhole assembly 22 in place, connection with the power supply at the surface of the earth is connected by lowering the drive rod string 24 slowly until it reaches the downhole assembly 22 with the stab-in rod extending upwardly in the receiver.

The receiver is open at the free end thereof, that being the end which, in space, is not connected to anything and is flared outwardly in order to essentially guide the stab-in rod into the centrally located opening in the receiver. As the receiver continues to descend on to the stab-in rod, with the configured portion of the stab-in rod engaged with those compatibly formed on the interior of the central bore of the receiver, resulting in a driving connection between the power supply on the surface and the overshot assembly 31.

A disconnection is achieved by reversing the process by drawing the drive rod string 24 upwardly, at which time it disconnects from the receiver.

While those skilled in the art will perceive some variation in the structural elements disclosed herein, it will be understood that the invention contemplates such variations which are within the contemplation of the claims,

I claim, as follows:

1. A system to connect a drive rod string to a downhole assembly in a well for the capture of subterranean fluids, the system comprising:

a casing within said well, and a production tubing situated within said casing, said production tubing having an upper and a lower end;

a downhole assembly, said downhole assembly having an upper and a lower end, said upper end of said downhole assembly attached to said lower end of said production tubing, said downhole assembly consisting of a fluid pumping system;

a drive rod string situated within said production tubing and extending from the surface to said downhole assembly located at the lower end of said production tubing, said drive rod string having an upper and a lower end;

an overshot assembly, said overshot assembly having an upper end and a lower end, said upper end being fixedly attached to said lower end of said drive rod string such that said overshot assembly is in rotational connection with said drive rod string; and a receiver shaft extending upwardly from said downhole assembly, said receiver shaft having an upper end and a lower end, said upper end protruding above said upper end of said downhole assembly and within said production tubing;

wherein said overshot assembly consists of a longitudinally extending tubular receptacle, having an upper end and a lower end, said tubular receptacle open at said lower end, said tubular receptacle having an inner bore with a noncircular contour on the inside surface of said inner bore;

wherein the outer surface of a portion of said receiver shaft being configured with a noncircular contour so as to fit within said tubular receptacle of said overshot assembly and mate with said noncircular contour of the inside surface of said tubular receptacle, whereby said receiver shaft is in torsional engagement with said tubular receptacle of said overshot assembly, whereby the rotation of said drive rod string and overshot assembly causes rotation of said receiver shaft;

wherein said contoured portion of said receiver shaft extends downward from said upper end of said receiver shaft;

wherein the length of said contoured portion of said receiver shaft is approximately the same length as the length of said inner bore of said tubular receptacle of said overshot assembly, whereby said tubular receptacle is free to move longitudinally relative to said receiver shaft, maintaining torsional connection with said receiver shaft while said receive shaft remains within said tubular receptacle; and wherein said lower end of said receiver shaft is in rotational connection with a drive shaft within said downhole assembly, said drive shaft connected to the rotational input of said fluid pumping system of said downhole assembly, such that rotation of the receiver shaft by the drive rod string causes the pumping of fluid in said well to the surface.

2. A system as in claim 1, wherein said noncircular contour on the inside surface of said inner bore of said tubular receptacle of said overshot assembly extends for less than the total length of said inner bore.

* * * * *